US011149972B2

(12) United States Patent
Bureau

(10) Patent No.: US 11,149,972 B2
(45) Date of Patent: Oct. 19, 2021

(54) ROOF VENT AND ANCHORING APPARATUS

(71) Applicant: Philippe Bureau, Calgary (CA)

(72) Inventor: Philippe Bureau, Calgary (CA)

( * ) Notice: Subject to any disclaimer, the term of this patent is extended or adjusted under 35 U.S.C. 154(b) by 372 days.

(21) Appl. No.: 16/243,946

(22) Filed: Jan. 9, 2019

(65) Prior Publication Data

US 2020/0217531 A1 Jul. 9, 2020

(51) Int. Cl.
*F24F 7/02* (2006.01)
*A62B 35/00* (2006.01)
*E04G 21/32* (2006.01)

(52) U.S. Cl.
CPC ..... *F24F 7/02* (2013.01); *A62B 35/0068* (2013.01); *E04G 21/3276* (2013.01)

(58) Field of Classification Search
CPC ..... F24F 7/02; A62B 32/0068; A62B 99/00; E04G 21/3276; E04G 21/328; E04G 21/3285
See application file for complete search history.

(56) References Cited

U.S. PATENT DOCUMENTS 5,011,106 A * 4/1991 Cody ..... A62B 35/0068 182/3
5,454,197 A * 10/1995 Horrigan ..... A62B 35/0068 52/199
5,561,952 A * 10/1996 Damron ..... E04D 13/0325 454/199
5,687,535 A * 11/1997 Rohlf ..... A62B 35/0068 52/713
9,458,640 B2 * 10/2016 Small ..... E04G 21/3295
9,492,693 B2 * 11/2016 Byrd ..... A62B 35/0068
10,898,741 B2 * 1/2021 Giroux ..... A62B 35/0068

* cited by examiner

*Primary Examiner* — Kenneth J Hansen
*Assistant Examiner* — Phillip Decker
(74) *Attorney, Agent, or Firm* — Gulf Coast Intellectual Property Group

(57) ABSTRACT

A roof vent and anchoring apparatus that is configured to be superposed a building and provide both a vent for the building and an anchor to receive a safety element operable to secure a human thereto. The roof vent and anchoring apparatus includes a base member that is planar in manner and adjacent the roof. A lower member extends upward from the first side of the base member. An upper member is superposed the lower member and provides coverage thereof. An anchor assembly including opposing block members and a rod member intermediate thereto is provided to receive a safety element coupled to a human. An anchoring assembly is operably coupled to the second side of the base member and is comprised of bolt members and a bar member. The anchoring assembly is configured to be secured to a roof support element underneath the roof of a building.

7 Claims, 3 Drawing Sheets

ROOF VENT AND ANCHORING APPARATUS

FIELD OF THE INVENTION

The present invention relates generally to ventilation devices for buildings, more specifically but not by way of limitation, a roof vent that is operably secured to the roof of a structure such as but not limited to a house wherein the roof vent further includes an anchoring member configured to provide a technique to secure an individual thereto so as to inhibit falling from a roof.

BACKGROUND

Millions of individuals regularly climb onto roofs of various structures such as but not limited to residential homes and commercial buildings. These individuals may be in charge of maintenance on the structure or may be the owner thereof and are required to climb onto the roof to execute a particular task. As is known in the art, numerous types of roof materials are utilized as the final layer for roofs. Roofing materials such as but not limited to composition shingles, tiles and metal are all commonly utilized as the final roofing layer on various structures. It is further known within the field of invention that most roofs are constructed to have a pitch. The pitch of the roof is the angle at which the roof is oriented. The pitch of the roof serves to provide various functions such as but not limited to water direction control and achieve a desired look to a structure.

One issue with conventional roof materials and the pitch thereof is the safety hazard presented to a user needing to ascend onto the roof to perform a required activity. The typical angle of a conventional roof and the material present a surface that is treacherous to traverse across. Thousands of accidents resulting in injuries and even death occur every year as a result of individuals traversing across roofs. All structures typically have what are known as roof vents. These vents provide a means for an exchange of air to occur between the building and the environment. Most single family resident structures will have roof vents that provide an atmospheric coupling to the attic of the structure and the atmosphere. These aforementioned structures can also have other elements on the roof such as but not limited to plumbing vents. It is not required by building code however to have available on a roof of a residential structure an anchoring means wherein a user can secure an item such as but not limited to a safety cable for use when traversing across a roof.

Accordingly, there is a need for a roof vent that is configured to be secured to a pitched roof of a structure such as but not limited to a residential home wherein the roof vent includes elements operable to facilitate the securing of a safety rope or similar item wherein the roof vent of the present invention can be used to anchor an individual superposed the roof.

SUMMARY OF THE INVENTION

It is the object of the present invention to provide a roof vent and anchoring apparatus that is configured to provide a technique to ensure the safety of an individual operably coupled thereto wherein the present invention is configured to provide a technique to inhibit the falling of an individual operably coupled thereto.

Another object of the present invention is to provide a roof vent and anchoring apparatus configured to receive a first end of a safety rope wherein the second end is secured to a user wherein the present invention includes a body manufactured from a suitable material such as but not limited to metal.

A further object of the present invention is to provide a roof vent and anchoring apparatus that is configured to provide a technique to ensure the safety of an individual operably coupled thereto wherein the present invention includes a base member that is parallel and adjacent to the roof to which the present invention is operably coupled.

Still another object of the present invention is to provide a roof vent and anchoring apparatus configured to receive a first end of a safety rope wherein the second end is secured to a user wherein the present invention includes a vent housing that is superposed the base member and extends outward therefrom.

An additional object of the present invention is to provide a roof vent and anchoring apparatus that is configured to provide a technique to ensure the safety of an individual operably coupled thereto wherein the vent housing of the present invention further includes an anchor assembly that is configured to receive a safety element secured thereto.

Yet a further object of the present invention is to provide a roof vent and anchoring apparatus configured to receive a first end of a safety rope wherein the second end is secured to a user wherein the present invention further includes an attachment assembly wherein the attachment assembly is opposite the base member from the vent housing.

Another object of the present invention is to provide a roof vent and anchoring apparatus that is configured to provide a technique to ensure the safety of an individual operably coupled thereto wherein the attachment assembly further includes support members extending downward from the bottom of the base member.

An alternate object of the present invention is to provide a roof vent and anchoring apparatus configured to receive a first end of a safety rope wherein the second end is secured to a user wherein the attachment assembly further includes a bar member that is operably coupled to the support members.

Still a further object of the present invention is to provide a roof vent and anchoring apparatus that is configured to provide a technique to ensure the safety of an individual operably coupled thereto wherein the attachment assembly is configured to secure to a structure such as but not limited to a roof truss.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
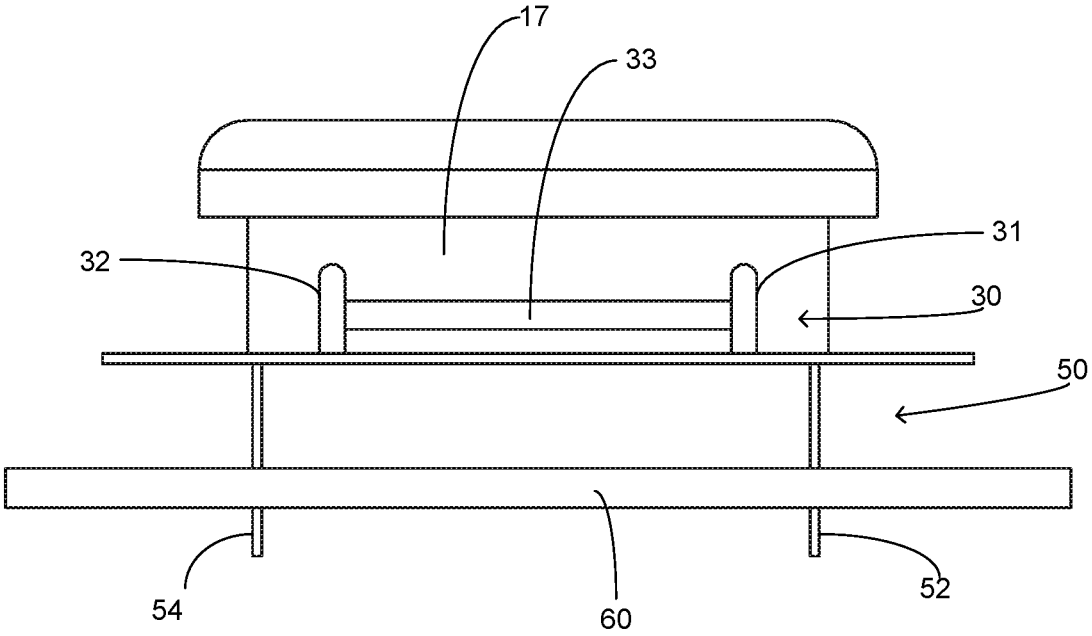
FIG. 1 is a side view of a preferred embodiment of the present invention.
Figure 2:
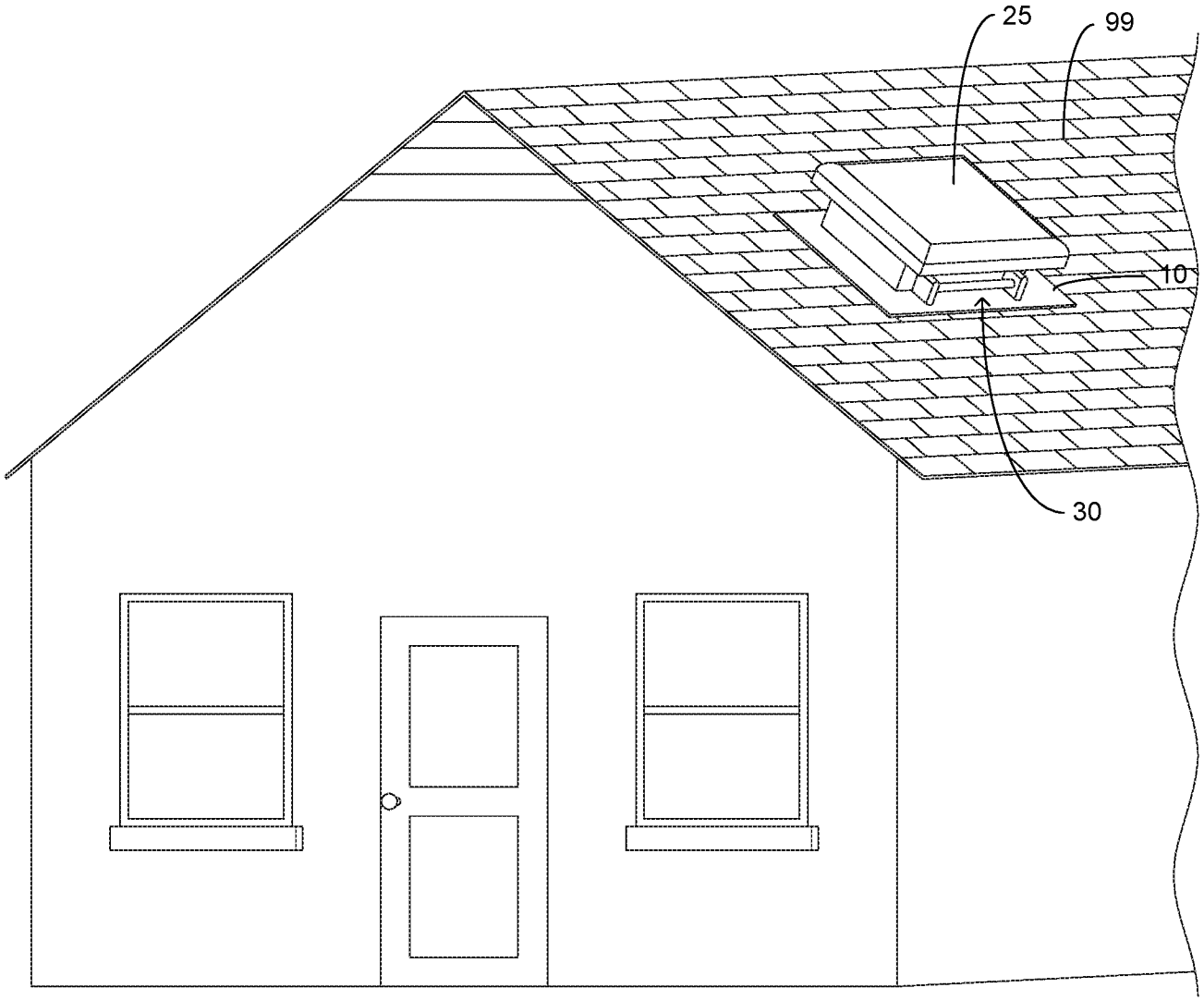
FIG. 2 is a perspective view of the present invention installed on an exemplary roof.
Figure 3:
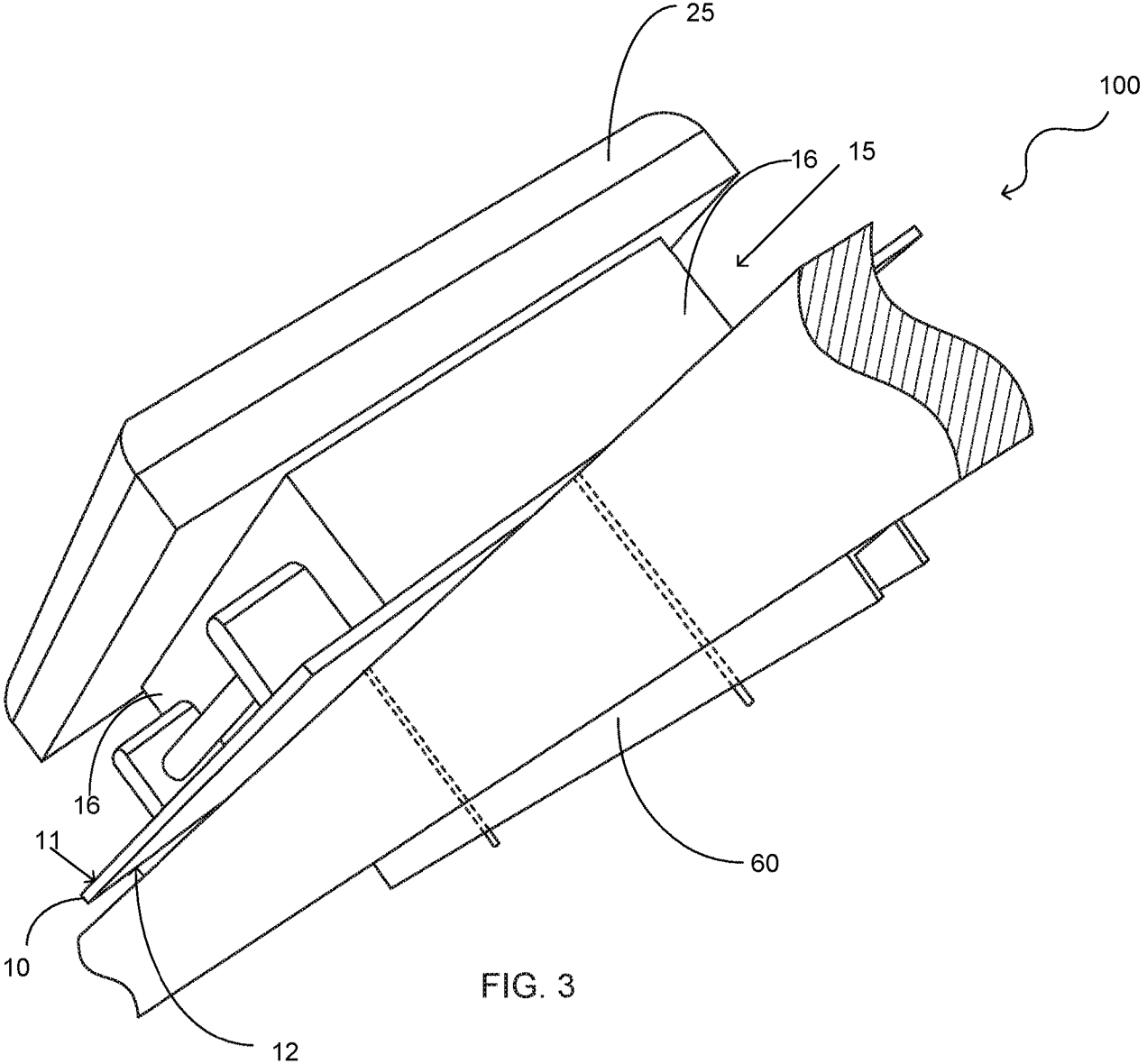
FIG. 3 is bottom perspective view showing a mounting technique of the present invention.

Referring now to the drawings submitted herewith, wherein various elements depicted therein are not necessarily drawn to scale and wherein through the views and figures like elements are referenced with identical reference numerals, there is illustrated a roof vent and anchoring apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular the Figures submitted as a part hereof, the a roof vent and anchoring apparatus 100 includes a base member 10. The base member 10 is planar in manner and manufactured from a suitable rigid material such as but not limited to metal. The base member 10 includes a first side 11 and a second side 12 wherein second side 12 is adjacent and superposed an exemplary roof 99 subsequent installation of the roof vent and anchoring apparatus 100. While the base member 10 is illustrated herein as being square in shape, it is contemplated within the scope of the present invention that the base member 10 could be provided in alternate shapes and sizes. The base member 10 is planar in manner so as to provide sealable engagement with conventional roofing materials such as but not limited to shingles. It should be understood within the scope of the present invention that the base member 10 could be provided in alternate thickness as required for a desired installation.

Secured to the first side 11 of the base member 10 and extending upward therefrom is lower member 15. Lower member 15 is comprised of a plurality of walls 16 that are integrally formed to create an interior volume (not illustrated herein). The walls 16 are manufactured from a suitable rigid material such as but not limited to metal and are secured to the base member 10 utilizing suitable techniques such as but not limited to welding. While the lower member 15 is illustrated herein as being square in shape with four walls 16, it is contemplated within the scope of the present invention that the lower member 15 could be comprised of as few as one wall 16 or more than four walls 16 depending upon the shape of the lower member 15. The roof vent and anchoring apparatus 100 is superposed an element such as but not limited to a plumbing vent with the interior volume of the lower member 15 being axially aligned therewith.

Superposed the lower member 15 is upper member 25. The upper member 25 is formed to provide coverage of the lower member 15 and specifically extend beyond the perimeter thereof in order to inhibit precipitation and the like from entering the interior volume of the lower member 15. The upper member 25 is manufactured from a suitable rigid material such as but not limited to metal and is formed in a shape that is similar to the shape formed by the walls 16 of the lower member 15.

The roof vent and anchoring apparatus 100 has integrally formed as a part thereof an anchor assembly 30. The anchor assembly 30 functions to provide an attachment point for an individual to secure a safety element such as but not limited to a safety line. The anchor assembly 30 includes a first block member 31, a second block member 32 and an attachment rod 33 wherein the attachment rod 33 is intermediate the first block member 31 and second block member 32. The anchor assembly 30 is manufactured from a suitable rigid material such as but not limited to metal and is secured utilizing durable techniques such as but not limited to welding. The first block member 31 and second block member 32 are secured to the front wall 17 and the first side 11 of the base member 10. Securing to the aforementioned locations provides the desired stability for the anchor assembly 30. The attachment rod 33 is operably coupled intermediate the first block member 31 and second block member 32. The attachment rod 33 is manufactured from a suitable rigid material such as a metal rod. The attachment rod 33 has a void intermediate the first side 11 of the base member 10 so as to accommodate any element such as but not limited to a carabineer clip. It should be understood within the scope of the present invention that the attachment rod 33 could be provided in alternate diameters.

The attachment assembly 50 is operable to ensure the mounting integrity of the a roof vent and anchoring apparatus 100 and its intended purpose to serve as an anchor for an individual coupled thereto with an element such as but not limited to a safety line. A conventional roof vent that is known in the art is only secured to a roof using nails and perhaps an adhesive. The present invention functions to provide an anchor point for an individual disposed on a roof 99. The attachment assembly 50 includes bolt member 52,54 and bar member 60. The attachment assembly 50 is configured to secure the roof vent and anchoring apparatus 100 to a structure underneath the exemplary roof 99 such as but not limited to a roof support truss. In order to ensure execution of the present invention and provide support for an individual, the attachment assembly 50 is secured to a roof support truss or similar object. The bolt members 52,54 are secured to the second side 12 of the base member 10 and extend downward therefrom. The bolt members 52,54 are opposedly located on the base member 10 and are of sufficient length to facilitate the execution of installation of the attachment assembly 50. The bolt members 52,54 are configured to engage bar member 60. Bar member 60 is manufactured from a suitable rigid material such as but not limited to metal and is of sufficient length to be operably coupled with the bolt members 52,54. The bar member 60 is elongated in shape and could be provided in alternate thickness or deflection rating so as to support a desired weight. The bar member 60 is configurable to secure to a single roof support element or engage more than one roof support element. It should be understood within the scope of the present invention that the bolt members 52,54 could have various configurations so as to facilitate attachment to the bar member 60 and could be present in alternate quantities.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A roof vent and anchoring apparatus that is operable to be superimposed over a roof of a building and provide an atmospheric vent and further provide the ability to provide a secure connection for a safety element configured to ensure the safety of a human on the roof wherein the roof vent and anchor apparatus comprises:

a base member, said base member being planar in manner, said base member having a first side and a second side, said base member being superimposed over the roof of the building;

a lower member, said lower member being secured to said first side of said base member, said lower member having a plurality of walls, said lower member extending upward from said first side of said base member, said plurality of walls of said lower member being perpendicular to said base member, an upper member, said upper member being secured to said lower member, said upper member opposite said base member, said upper member configured to cover said lower member;

an anchor assembly, said anchor assembly being secured to said base member and one of said plurality of walls of said lower member, said anchor assembly having a first block member and a second block member, said anchor assembly further including a rod member, said rod member being intermediate said first block member and said second block member; and an attachment assembly, said attachment assembly being secured to said second side of said base member, said attachment assembly having at least one bolt member, said attachment assembly having a bar member, said bar member being coupled to said at least one bolt member distal to said base member, wherein said bar member is in axial alignment with a roof truss supporting the roof;

wherein said first block member is secured to said first side of said base member and a front wall of said lower member;

wherein said second block member is secured to said first side of said base member and a front wall of said lower member;

wherein said rod member is secured to said first block member and said second block member so as to have a void intermediate said rod member and said first side of said base member wherein said bar member is elongated in shape and having a width equal to that of a thickness of the roof truss.

2. The roof vent and anchoring apparatus as recited in claim 1, wherein the roof vent and anchoring apparatus is manufactured from metal.

3. A roof vent and anchoring apparatus configured to provide a vent for a building and provide an anchoring location for a safety element that is operable to ensure safety of an individual traversing on a roof wherein the roof vent and anchoring apparatus comprises:

a base member, said base member being planar in manner, said base member having a first side and a second side, said base member being superimposed over the roof of the building;

a lower member, said lower member being secured to said first side of said base member, said lower member having a plurality of walls, said lower member extending upward from said first side of said base member, said plurality of walls of said lower member being perpendicular to said base member, an upper member, said upper member being secured to said lower member, said upper member opposite said base member, said upper member configured to cover said lower member;

an anchor assembly, said anchor assembly being secured to said base member and one of said plurality of walls of said lower member, said anchor assembly having a first block member and a second block member, said anchor assembly further including a rod member, said rod member being intermediate said first block member and said second block member, said rod member being stationary with respect to said first block member and said second block member; and an attachment assembly, said attachment assembly being secured to said second side of said base member, said attachment assembly having a first bolt member and a second bolt member, said attachment assembly having a bar member, said bar member having a first end and a second end, said bar member being coupled to said first bolt member and said second bolt member distal to said base member, wherein said bar member is in axial longitudinal alignment with a roof truss supporting the roof, said bar member having a width equivalent to that of a thickness of the roof truss.

4. The roof vent and anchoring apparatus as recited in claim 3, wherein said first bolt member is secured to said bar member proximate said first end thereof.

5. The roof vent and anchoring apparatus as recited in claim 4, wherein said second bolt member is secured to said bar member proximate the second end thereof.

6. The roof vent and anchoring apparatus as recited in claim 5, wherein said first block member and said second block member are secured to said first side of said base member and a front wall of said lower member.

7. The roof vent and anchoring apparatus as recited in claim 6, wherein the roof vent and anchoring apparatus is manufactured from metal.

* * * * *